US005336010A

United States Patent [19]

Shiomitsu

[11] Patent Number: 5,336,010

[45] Date of Patent: Aug. 9, 1994

[54] PEN POINT STRUCTURE AND FOUNTAIN PEN EQUIPPED WITH THE SAME

[76] Inventor: Kuniyoshi Shiomitsu, Hirose-4-chome22-10, Kokubushi, Kagoshima-ken, Japan

[21] Appl. No.: 106,797

[22] Filed: Aug. 16, 1993

Related U.S. Application Data

[63] Continuation of Ser. No. 858,481, Mar. 27, 1992, abandoned.

[30] Foreign Application Priority Data

Oct. 9, 1991 [JP] Japan ..... 3-090666[U]

[51] Int. Cl.[5] ..... B43K 5/00

[52] U.S. Cl. ..... 401/199; 401/261; 401/265; 401/292; 401/227

[58] Field of Search ..... 401/227, 229, 242, 249, 401/199, 198, 222, 224, 265, 261, 258

[56] References Cited

U.S. PATENT DOCUMENTS

| | | | |
|---|---|---|---|
| 1,903,965 | 4/1933 | Frank | 401/249 X |
| 2,283,333 | 5/1942 | Martin | 401/242 X |
| 2,431,015 | 11/1947 | Andrews et al. | 401/261 X |
| 2,881,737 | 4/1959 | Young | 401/242 X |
| 3,203,025 | 8/1965 | Schreur | 401/198 X |
| 3,520,629 | 7/1970 | Otsuka | 401/265 X |
| 3,614,248 | 10/1971 | Otsuka | 401/265 X |
| 5,087,144 | 2/1992 | Wada et al. | 401/227 X |
| 5,096,322 | 3/1992 | Shiga et al. | 401/261 X |

FOREIGN PATENT DOCUMENTS

| | | | |
|---|---|---|---|
| 2355188 | 5/1974 | Fed. Rep. of Germany | 401/276 |
| 62428 | 5/1979 | Japan | 401/199 |

*Primary Examiner*—Danton D. DeMille

*Attorney, Agent, or Firm*—Oblon, Spivak, McClelland, Maier & Neustadt

[57] ABSTRACT

A pen point structure suitable for use in a fountain pen comprises a body formed from a mixture of hard inorganic powder and a binder resin and provided with at least one ink flow channel and at least one air flow channel. The hard inorganic powder is preferably lock crystal powder, quartz powder, alumina powder, silica powder, corundum powder, ceramic powder, high m.p. metal powder, metal carbide powder or metal nitride powder, or a mixture thereof. The binder resin is preferably a phenol resin, urea resin, melamine resin or unsaturated polyester resin, or a mixture thereof. A fountain pen constructed of such a pen point structure, an ink reservoir and a pen casing is also described.

16 Claims, 2 Drawing Sheets

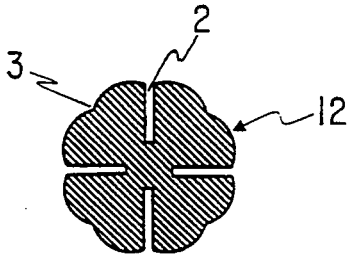
FIG. 5
FIG. 6
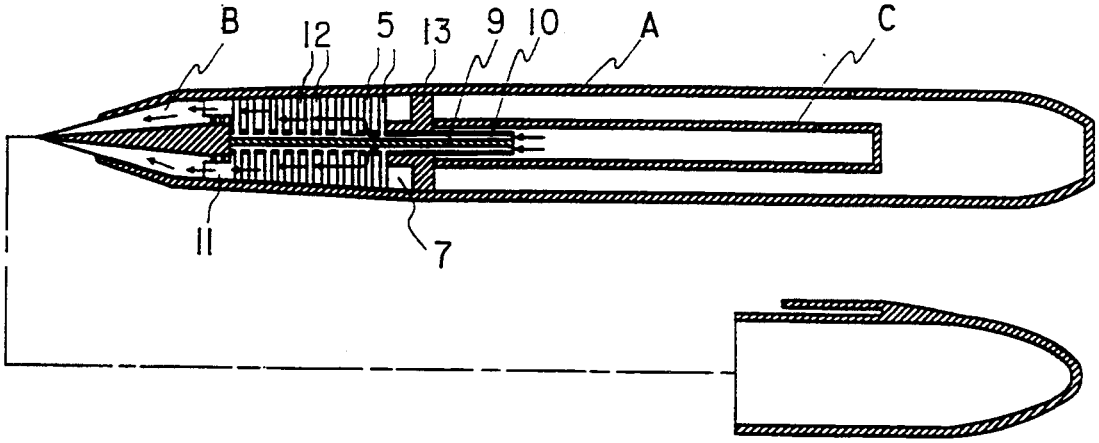

PEN POINT STRUCTURE AND FOUNTAIN PEN EQUIPPED WITH THE SAME

This application is a continuation of application Ser. No. 07/858,481, filed on Mar. 27, 1992, now abandoned.

BACKGROUND OF THE INVENTION

1) Field of the Invention

This invention relates to a pen point structure and also to a fountain pen equipped with the pen point structure. More specifically, the present invention is concerned with a pen point structure comprising a body, which is novel in both forming material and shape, and also with a fountain pen equipped with the pen point structure.

2) Description of the Related Art

As conventional writing or drawing tools making use of ink, a variety of tools are known including dip-and-write pens, fountain pens, ball-point pens, felt-tip pens and the like.

Among these, dip-and-write pens have a pen point made of a metal, glass or the like and are suited particularly as means for writing or drawing (hereinafter collectively referred to as "writing" for the sake of brevity) slender and fine letters or lines (hereinafter collective referred to as "letters" for the sake of brevity).

A dip-and-write pen is, however, accompanied by the inconvenience that, whenever writing letters, its pen point must be dipped in ink to have the ink adhered on the pen point prior to writing letters and, due to the limited amount of the ink which can. be adhered there, many letters cannot be written by a single dip. It is also accompanied by the inconvenience that writing is feasible only with its pen point directed in a specific direction. Further, a so-called glass pen having a glass-made pen point is accompanied by the problem that the glass-made pen point is more susceptible to breakage compared to a metal-made pen point.

In contrast, a fountain pen equipped with an ink reservoir such as an ink cartridge or a fountain pen filler allows to write a number of fine letters. It is, however, accompanied by the problems that it is costly due to the use of a noble metal such as gold or silver in its pen point and, similarly to the dip-and-write pen, it permits writing only with its pen point directed in a specific direction.

On the other hand, felt-tip pens which have been finding wide-spread utility in recent years use a pen point formed of a porous synthetic resin, and the porous pen point is soaked with ink to permit writing. A felt-tip pen is therefore an economical and convenient writing tool which permits writing irrespective of the direction of its pen point. Due to the use of the porous synthetic resin, however, the pen point is soft and frail. It is therefore necessary to increase the thickness of the pen point to some extent, whereby it is difficult to write fine letters with the felt-tip pen. The pen point is also prone to deformation and breakage in the course of its use over a long time, leading to the problem that it cannot be used to write many fine letters.

SUMMARY OF THE INVENTION

An object of this invention is to provide an economical and convenient pen tip structure permitting writing of many fine letters and the like irrespective of its direction and also to provide a fountain pen equipped with the pen tip structure.

With a view toward overcoming the above-described inconvenience and problems described above, the present inventor has proceeded with an extensive investigation. As a result, it has been found that these inconvenience and problems can be overcome by forming a pen tip structure of a particular shape from a specific material.

In one aspect of this invention, there is thus provided a pen point structure comprising a body formed from a mixture of hard inorganic powder and a binder resin, said body being provided with at least one ink flow channel and at least one air flow channel.

In another aspect of this invention, there is also provided a fountain pen having a pen point structure, an ink reservoir and a pen casing, comprising as the pen point structure the pen point structure described above.

Owing to the material and shape described above, the pen point structure according to this invention permits writing of many fine letters irrespective of its direction. The fountain pen according to this invention, which makes use of the above-described pen point structure, therefore has an excellent practical value as a convenient and economical writing tool.

BRIEF DESCRIPTION OF THE INVENTION

The above and other objects, features and advantages of the present invention will become apparent from the following description and the appended claims, taken in conjunction with the accompanying drawings, in which:

FIG. 5 is a transverse cross-sectional view of the pen point structure B, taken in the direction of arrows V—V of FIG. 1; and FIG. 6 is a longitudinal cross-sectional view of a fountain pen according to this invention, said fountain pen being equipped with the pen tip structure of FIGS. 1–5, taken in the direction of arrows VI—VI of FIG. 4.

DETAILED DESCRIPTION OF THE INVENTION

Figure 1:
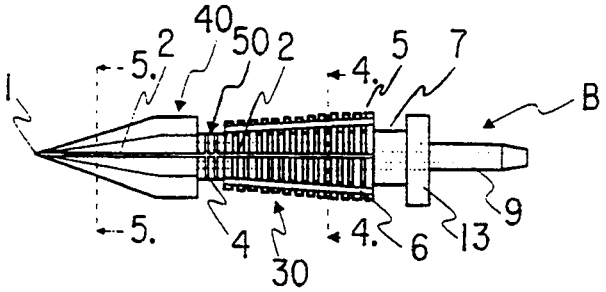
FIG. 1 is a side view of a pen point structure B according to this invention.
Figure 2:
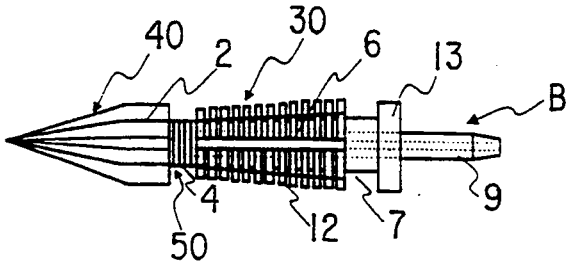
FIG. 2 is a top plan view of the pen point structure B of FIG. 1.

A first feature of the present invention resides in the formation of the pen point structure B with a mixture of hard inorganic powder and a binder resin so that the pen point structure B has been imparted with improved hardness and brittle resistance.

As the hard inorganic powder employed in this invention, any power can be used insofar as it is inorganic powder having a high degree of hardness. Preferred examples of the hard inorganic powder include rock crystal powder, quartz powder, alumina powder, silica powder, corundum powder, ceramic powders, high m.p. metal powders, metal carbide powders and metal nitride powders as well as mixtures thereof. It is generally preferable to use these hard metal powders as fine powders having a particle size ranging from submicrons to microns.

Although the binder resin employed for the formation of the pen point structure according to this invention may be a conventional thermoplastic resin such as an acrylic resin, a polyester resin or a vinyl resin, a thermosetting resin is more preferred. Any conventionally-known thermosetting resins can be used. Preferred examples of thermosetting resins include phenol resins, urea resins, melamine resins and unsaturated polyester resins as well as mixture thereof. Preferred unsaturated polyester resins include, for example, those obtained by polycondensation of polycarboxylic acids, including unsaturated polycarboxylic acids such as maleic anhydride and fumaric acid, with polyols such as ethylene glycol, propylene glycol, glycerin and bisphenol A. They may be added, as needed, with a polymerizable monomer such as styrene monomer, methyl methacrylate or ethylene glycol di(meth)acrylate in order to obtain them in a liquid form.

No particular limitation is imposed on the process for the formation of the pen point structure. For example, the binder resin can be converted into a liquid form with an organic solvent or a monomer or can be emulsified at a high concentration in water by a surfactant or the like. The hard inorganic powder can be added to and mixed with the resultant liquid, and the resulting mixture can be kneaded to disperse the former evenly in the latter. The mass so prepared can be hot-pressed in a desired mold optionally after drying and solidifying the mass into a plate-like form or the like and finely grinding the same. Where the binder resin is soluble under alkaline conditions, the binder resin can be dissolved in alkaline water. Following the procedures described above, the hard inorganic powder can be mixed and dispersed, and the resulting mass can be dried and then formed likewise. As a further alternative, the binder resin can be heated into a melt or the above-described unsaturated polyester can be dissolved in a monomer. The hard inorganic powder can then be kneaded and dispersed in the melt or solution. The mass so prepared can then be formed by injection molding, casting, hot-pressing or the like.

Here, the mass can be hot-pressed at a temperature where the binder resin is thermally decomposed or at a temperature where particles of the hard inorganic powder are fused and united together, for example, at a temperature of from about 1,200° C. to about 1,800° C. In this case, the hard inorganic powder is sintered and carbonized, thereby providing a pen point structure which is excellent in strength, hardness, abrasion resistance and the like, is in a fine porous form and is superb in ink transfer ability. Of course, depending on the application field of the pen point structure (for example, where very high performance is not required like a disposable ball-point pen or felt-tip pen, hot-pressing can be conducted at a temperature where the binder resin is not decomposed.

No particular limitation is imposed on the mixing ratio of the binder resin to the hard inorganic powder. It is however desirable to mix the binder resin and hard inorganic powder at a ratio of about 1–5 to about 9–5, preferably about 1–3 to about 9–7 because this mixing ratio can give suitable hardness and strength to the pen point structure.

A second feature of this invention resides in the formation of the pen point structure B into a specific shape as illustrated in FIG. 1 to FIG. 6.

Referring to these figures, the pen point structure B according to the present invention is composed of a base portion 30, a free end portion 40 and a small-diameter portion 50 extending between the base portion 30 and the free end portion 40. The free end portion 40 is in the form of a spindle pointed at the free end thereof and has a substantially octagonal shape in transverse cross-section (see FIG. 3).

Figure 3:
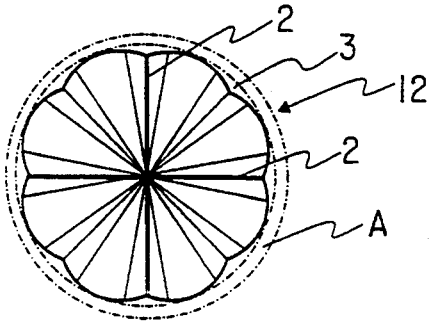
FIG. 3 is an end view of the pen point structure B of FIG. 1, as viewed from the side of its writing point.
Figure 4:
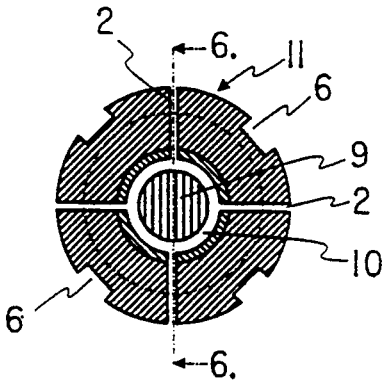
FIG. 4 is a transverse cross-sectional view of the pen point structure B, taken in the direction of arrows IV—IV of FIG. 1.

The free end portion 40 is provided with ink flow channels 2 for guiding ink to a writing point 1. Preferably, four ink flow channels 2 are symmetrically formed as shown in FIGS. 3–4. The ink flow channels 2 continuously extend through the small diameter portion 50 and the base portion 30 as depicted in FIG. 1, and are in communication with an annular flow passage 10 formed axially in an ink feed tube 9 so as to feed therethrough ink from an ink cartridge C shown in FIG. 6. Designated at numeral 3 in FIG. 3 are air inlets formed between the free end portion 40 and a pen casing A when the pen point structure B is inserted in and surrounded by the pen casing A. The air inlets 3 are in communication with a space 11 (see FIG. 6) formed between the small-diameter portion 50 and the pen casing A, and further in communication with an air pressure compartment 7 (see FIG. 6) via air flow channels 6 (see FIG. 2) formed in the base portion 30. The air inlets 3 are also in communication with radial air slots 5 (see FIG. 1) formed in the periphery of the base portion 30 to control the pressure.

In the small-diameter portion 50 by which the free end portion 40 and the base portion 30 are connected to each other, plural, preferably 2–4 ink grooves 4 are formed at right angles relative to the ink flow channels 2. These ink grooves 4 serve to control the amount of ink to be fed to the writing point 1 of the free end portion 40.

Around the circumference of the base portion 30, many disks 12 are provided at right angles relative to the central axis of the base portion 30. The disks 12 define gaps therebetween, whereby the radial air slots 5 are formed. Since the ink flow channels 2 are cut in at right angles relative to the disks 12 (see FIG. 4), the ink can be drawn radially and outwardly by capillary action from the annular flow passage 10 into the ink flow channels 2 which extend to the small-diameter portion 50 and the free end portion 40. The ink therefore flows through the ink flow channels 2 and reaches the writing point 1. A cartridge-fixing portion 13 is formed at one end of the base portion 30, which end is opposite to the small-diameter portion 50. The cartridge-fixing portion 13 has an outer diameter such that, when the pen point structure B is received in the pen casing A, the cartridge-fixing portion 13 is in contact with an inner wall of the pen casing A. Through the cartridge-fixing portion 13, the ink feed tube 9 extends in a direction away from the small-diameter portion 50 so that attachment of the ink cartridge C can be facilitated.

A description will next be made of ink feeding and air pressure control. After the ink cartridge C has been attached to the ink feed tube 9 as shown in FIG. 6, the pen point structure B with the ink cartridge C attached thereto is fitted in the pen casing A. When the pen casing A is held by fingers in this state, the writing point 1 faces downwardly so that the ink flows under gravity from the cartridge C into the ink flow passage 10 formed in the ink feed tube 9. The ink is therefore drawn into the ink flow channels 2 extending across the air slots 5 which are defined between the adjacent disks 12 provided on the base portion 30. Through the ink flow channels 2, the ink flows further to the writing point 1 by way of the small-diameter portion 50 and the free end portion 40.

At the same time, air is drawn through the air inlets 3 (see FIG. 3) provided in the free end portion 40 of the pen point structure B. The air flows to the air pressure compartment 7 via the space 11 and the air flow channels 6. Since this air pressure compartment 7 has been warmed up by fingers, the air is caused to expand to a suitable extent so that more ink is fed to the writing point 1. As the ink is consumed, the pressure inside the ink cartridge C gradually drops. This pressure drop is compensated by a means similar to that employed in conventional cartridge-type fountain pens. This technique is known very well in the present field of art so that its description is omitted herein.

The fountain pen according to the present invention features the use of the pen point structure of this invention as illustrated in FIG. 6. The fountain pen comprises, for example, the pen casing A, the pen point structure B and the ink reservoir C. The fountain pen is in the form of a conventional fountain pen in the illustrated embodiment. It is, however, to be noted that no limitation is imposed on the shapes and materials of the pen casing A and ink reservoir C. Therefore, the fountain pen of this invention can also have a similar shape to a ball-point pen or a felt-tip pen.

I claim:

1. A pen point structure, comprising:

a body formed from a mixture of hard inorganic powder and a binder resin, said body including an end portion of an octagonal cross-section and having a writing point, a free end portion, and a small diameter portion forming an annular space extending between said end portion and said free end portion, a plurality of ink flow channels and an annular ink flow passage formed axially within said body and in communication with said ink flow channels, said ink flow channels extending longitudinally along the length of said body, a plurality of ink grooves in communication with said ink flow channels formed in said small diameter portion perpendicular to said ink flow channels, and a plurality of air flow channels extending longitudinally along the length of said end portion and said free end portion of said body.

2. The structure of claim 1, wherein said air flow channels communicate with said annular space.

3. The structure of claim 1, comprising 2–4 ink flow channels and 2–4 air flow channels.

4. The structure of claim 1, wherein said free end portion includes a plurality of annular disks positioned at right angles to the length of said body, said disks defining radial air slots therebetween.

5. The structure of claim 4, wherein said radial slots are in communication with said air flow channels in said free end portion.

6. The structure of claim 5, further comprising a cartridge-fixing portion in said free end portion defining an annular space between said radial slots and said cartridge fixing portion.

7. The structure of claim 6, wherein said annular space between said radial slots and said cartridge-fixing portion is in communication with said air flow channels in said free end portion.

8. The structure of claim 1, wherein said hard inorganic powder is selected from the group consisting of lock crystal powder, quartz powder, alumina powder, silica powder, corundum powder, ceramic powder, high melting point metal powder, metal carbide powder, metal nitride powder and mixtures thereof, and said binder resin is selected from the group consisting of phenol resins, urea resins, melamine resins, unsaturated polyester resins and mixtures thereof.

9. A fountain pen having a ink reservoir, a pen casing and the pen point structure of claim 1.

10. A fountain pen having an ink reservoir, a pen casing and the pen point structure of claim 2.

11. A fountain pen having an ink reservoir, a pen casing and the pen point structure of claim 3.

12. A fountain pen having an ink reservoir, a pen casing and the pen point structure of claim 4.

13. A fountain pen having an ink reservoir, a pen casing and the pen point structure of claim 5.

14. A fountain pen having an ink reservoir, a pen casing and the pen point structure of claim 6.

15. A fountain pen having an ink reservoir, a pen casing and the pen point structure of claim 7.

16. A fountain pen having an ink reservoir, a pen casing and the pen point structure of claim 8.

* * * * *